US007908047B2

(12) United States Patent
Smith et al.

(10) Patent No.: US 7,908,047 B2
(45) Date of Patent: Mar. 15, 2011

(54) METHOD AND APPARATUS FOR RUN-TIME INCORPORATION OF DOMAIN DATA CONFIGURATION CHANGES

(75) Inventors: Brian Scott Smith, Melbourne, FL (US); Daniel Keith Pagano, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 171 days.

(21) Appl. No.: 11/142,260

(22) Filed: Jun. 2, 2005

(65) Prior Publication Data

US 2005/0288832 A1 Dec. 29, 2005

Related U.S. Application Data

(60) Provisional application No. 60/583,359, filed on Jun. 29, 2004.

(51) Int. Cl.
*G05D 1/00* (2006.01)

(52) U.S. Cl. ..... 701/19; 701/117; 717/170; 717/176; 717/177; 709/229; 709/203; 709/217; 246/3; 246/44; 246/187 A; 246/2 R

(58) Field of Classification Search ..... 701/19, 701/20, 117; 246/2 R, 167, 415, 473, 3, 246/44, 187 A; 715/824, 825; 717/170, 717/176, 177; 709/203, 217, 229
See application file for complete search history.

(56) References Cited

U.S. PATENT DOCUMENTS

| | | | |
|---|---|---|---|
| 3,575,594 | A | 4/1971 | Elcan |
| 3,734,433 | A | 5/1973 | Metzner |
| 3,794,834 | A | 2/1974 | Auer, Jr. et al. |
| 3,839,964 | A | 10/1974 | Gayot |
| 3,895,584 | A | 7/1975 | Paddison |
| 3,944,986 | A | 3/1976 | Staples |
| 4,099,707 | A | 7/1978 | Anderson |
| 4,122,523 | A | 10/1978 | Morse et al. |
| 4,361,300 | A | 11/1982 | Rush |
| 4,361,301 | A | 11/1982 | Rush |
| 4,610,206 | A | 9/1986 | Kubala et al. |
| 4,669,047 | A | 5/1987 | Chucta |
| 4,791,871 | A | 12/1988 | Mowll |
| 4,843,575 | A | 6/1989 | Crane |
| 4,883,245 | A | 11/1989 | Erickson, Jr. |
| 4,926,343 | A | 5/1990 | Tsuruta et al. |
| 4,937,743 | A | 6/1990 | Rassman et al. |

(Continued)

FOREIGN PATENT DOCUMENTS

| | | |
|---|---|---|
| CA | 2057039 | 12/1990 |

(Continued)

OTHER PUBLICATIONS

Crone, et al., "Distributed Intelligent Network Management for the SDI Ground Network," IEEE, 1991, pp. 722-726, MILCOME '91.

(Continued)

*Primary Examiner* — Mark Hellner
*Assistant Examiner* — Redhwan Mawari
(74) *Attorney, Agent, or Firm* — Duane Morris LLP

(57) ABSTRACT

A method and apparatus for implementing a run-time configuration change for domain data in a database for an information systems where the domain data defines entities which are acted upon by the information system and where the reconfiguration of the domain data can take place without taking the information system offline and making it inaccessible to users.

12 Claims, 6 Drawing Sheets

U.S. PATENT DOCUMENTS

| | | | | |
|---|---|---|---|---|
| 5,038,290 | A | 8/1991 | Minami | |
| 5,063,506 | A | 11/1991 | Brockwell et al. | |
| 5,155,837 | A * | 10/1992 | Liu et al. | 709/221 |
| 5,177,684 | A | 1/1993 | Harker et al. | |
| 5,222,192 | A | 6/1993 | Shafer | |
| 5,229,948 | A | 7/1993 | Wei et al. | |
| 5,237,497 | A | 8/1993 | Sitarski | |
| 5,265,006 | A | 11/1993 | Asthana et al. | |
| 5,289,563 | A | 2/1994 | Nomoto et al. | |
| 5,311,438 | A | 5/1994 | Sellers et al. | |
| 5,331,545 | A | 7/1994 | Yajima et al. | |
| 5,332,180 | A | 7/1994 | Peterson et al. | |
| 5,335,180 | A | 8/1994 | Takahashi et al. | |
| 5,365,516 | A | 11/1994 | Jandrell | |
| 5,390,880 | A | 2/1995 | Fukawa et al. | |
| 5,410,668 | A * | 4/1995 | Hilton | 711/139 |
| 5,420,883 | A | 5/1995 | Swensen et al. | |
| 5,437,422 | A | 8/1995 | Newman | |
| 5,450,589 | A * | 9/1995 | Maebayashi et al. | 717/170 |
| 5,463,552 | A | 10/1995 | Wilson et al. | |
| 5,467,268 | A | 11/1995 | Sisley et al. | |
| 5,487,516 | A | 1/1996 | Murata et al. | |
| 5,541,848 | A | 7/1996 | McCormack et al. | |
| 5,555,418 | A * | 9/1996 | Nilsson et al. | 717/153 |
| 5,623,413 | A | 4/1997 | Matheson et al. | |
| 5,745,735 | A | 4/1998 | Cohn et al. | |
| 5,794,172 | A | 8/1998 | Matheson et al. | |
| 5,823,481 | A | 10/1998 | Gottschlich | |
| 5,825,660 | A | 10/1998 | Cagan et al. | |
| 5,828,979 | A | 10/1998 | Polivka et al. | |
| 5,850,617 | A | 12/1998 | Libby | |
| 5,960,204 | A * | 9/1999 | Yinger et al. | 717/176 |
| 6,032,905 | A | 3/2000 | Haynie | |
| 6,115,700 | A | 9/2000 | Ferkinhoff et al. | |
| 6,125,311 | A | 9/2000 | Lo | |
| 6,144,901 | A | 11/2000 | Nickles et al. | |
| 6,154,735 | A | 11/2000 | Crone | |
| 6,195,750 | B1 * | 2/2001 | Ellsworth | 713/100 |
| 6,250,590 | B1 | 6/2001 | Hofestadt et al. | |
| 6,351,697 | B1 | 2/2002 | Baker | |
| 6,377,877 | B1 | 4/2002 | Doner | |
| 6,393,362 | B1 | 5/2002 | Burns | |
| 6,405,186 | B1 | 6/2002 | Fabre et al. | |
| 6,453,344 | B1 * | 9/2002 | Ellsworth et al. | 709/220 |
| 6,453,468 | B1 * | 9/2002 | D'Souza | 717/168 |
| 6,459,965 | B1 | 10/2002 | Polivka et al. | |
| 6,587,764 | B2 | 7/2003 | Nickles et al. | |
| 6,637,703 | B2 | 10/2003 | Matheson et al. | |
| 6,654,682 | B2 | 11/2003 | Kane et al. | |
| 6,766,228 | B2 | 7/2004 | Chirescu | |
| 6,789,005 | B2 | 9/2004 | Hawthorne | |
| 6,799,097 | B2 | 9/2004 | Villarreal Antelo | |
| 6,799,100 | B2 | 9/2004 | Burns | |
| 6,853,889 | B2 | 2/2005 | Cole | |
| 6,856,865 | B2 | 2/2005 | Hawthorne | |
| 6,976,065 | B2 * | 12/2005 | Kaiser et al. | 709/221 |
| 6,976,079 | B1 * | 12/2005 | Ferguson et al. | 709/229 |
| 7,006,796 | B1 | 2/2006 | Hofmann et al. | |
| 7,188,057 | B2 * | 3/2007 | Birkelbach et al. | 703/7 |
| 7,188,163 | B2 * | 3/2007 | Srinivasan et al. | 709/221 |
| 2002/0120724 | A1 * | 8/2002 | Kaiser et al. | 709/221 |
| 2003/0101245 | A1 * | 5/2003 | Srinivasan et al. | 709/221 |
| 2003/0105561 | A1 | 6/2003 | Nickles et al. | |
| 2003/0177287 | A1 * | 9/2003 | Drogichen et al. | 710/1 |
| 2003/0177346 | A1 * | 9/2003 | Drogichen et al. | 713/100 |
| 2003/0183729 | A1 | 10/2003 | Root et al. | |
| 2003/0236598 | A1 * | 12/2003 | Villarreal Antelo et al. | 701/19 |
| 2004/0010432 | A1 | 1/2004 | Matheson et al. | |
| 2004/0034556 | A1 | 2/2004 | Matheson et al. | |
| 2004/0093196 | A1 | 5/2004 | Hawthorne | |
| 2004/0093245 | A1 | 5/2004 | Matheson et al. | |
| 2004/0228310 | A1 * | 11/2004 | Collins | 370/338 |
| 2004/0253956 | A1 * | 12/2004 | Collins | 455/445 |
| 2004/0267415 | A1 | 12/2004 | Lacote et al. | |
| 2005/0107890 | A1 | 5/2005 | Minkowitz et al. | |
| 2005/0125744 | A1 * | 6/2005 | Hubbard et al. | 715/824 |
| 2005/0192720 | A1 | 9/2005 | Christie et al. | |
| 2006/0074544 | A1 | 4/2006 | Morariu et al. | |

FOREIGN PATENT DOCUMENTS

| | | |
|---|---|---|
| CA | 2066739 | 2/1992 |
| CA | 2046984 | 6/1992 |
| CA | 2112302 | 6/1994 |
| CA | 2158355 | 10/1994 |
| EP | 0108363 | 5/1984 |
| EP | 0193207 | 9/1986 |
| EP | 0341826 | 11/1989 |
| EP | 0554983 | 8/1993 |
| FR | 2692542 | 12/1993 |
| GB | 1321053 | 6/1973 |
| GB | 1321054 | 6/1973 |
| JP | 3213459 | 9/1991 |
| WO | WO 90/03622 | 4/1990 |
| WO | WO 93/15946 | 8/1993 |

OTHER PUBLICATIONS

Ghedira, "Distributed Simulated Re-Annealing for Dynamic Constraint Satisfaction Problems," IEEE 1994, pp. 601-607.

Hasselfield, et al., "An Automated Method for Least Cost Distribution Planning," IEEE Transactions on Power Delivery, vol. 5, No. 2, Apr. 1990, 1188-1194.

Herault, et al., "Figure-Ground Discrimination: A Combinatorial Optimization Approach," IEEE Transactions on Pattern Analysis & Machine Intelligence, vol. 15, No. 9, Sep. 1993, 899-914.

Igarashi, "An Estimation of Parameters in an Energy Fen Used in a Simulated Annealing Method," IEEE, 1992, pp. IV-180-IV-485.

Komaya, "A New Simulation Method and its Application to Knowledge-based Systems for Railway Scheduling," May 1991, pp. 59-66.

Puget, "Object Oriented Constraint Programming for Transportation Problems," IEEE 1993, pp. 1-13.

Sasaki, et al., "Development for a New Electronic Blocking System," QR of RTRI, vol. 30, No. 4, Nov. 1989, pp. 198-201.

Scherer, et al., "Combinatorial Optimization for Spacecraft Scheduling," 1992 IEEE International Conference on Tolls with AI, Nov. 1992, pp. 120-126.

Watanabe, et al., "Moving Block System with Continuous Train Detection Utilizing Train Shunting Impedance of Track Circuit," QR of RTRI, vol. 30, No. 4, Nov. 1989, pp. 190-197.

* cited by examiner

METHOD AND APPARATUS FOR RUN-TIME INCORPORATION OF DOMAIN DATA CONFIGURATION CHANGES

This application claims the priority of U.S. Provisional Application No. 60/583,359 filed Jun. 29, 2004, which is incorporated herein by reference.

This application is directed to implementing domain data configuration changes, additions, and deletions during the run-time operations of a software system.

Data is critical to virtually all information systems, and the accuracy, completeness, and availability of data is a distinct measure of an information system's value. Complex information systems, such as those supporting thousands of transactions, queries, and user interactions per hour, typically include one or more databases responsible for maintaining and managing the vast amounts of operational and archival data. Transient operational data is particularly sensitive to the disruption of run-time operations and, if the system is vital, often requires highly specialized measures to protect it (e.g., fail-over, redundancy, and hot-standbys for sustained operation, recovery, and prevention of data loss). Among the transient data in use, statically figured data normally defines the fixed domain environment or context within which the system operates, while dynamic data exists temporarily to facilitate operations and act as a vehicle for persisting event data. In some industries and public sector applications, the information systems in use do not require changes to the definition of their static domain environment data very often. In other businesses and government systems, however, the need to make such changes is both frequent and ongoing. Such an information system may require monthly, weekly, or even daily modifications to its statically configured domain data. Depending on system design and the extent of reconfiguration, implementing changes typically requires taking the software system off-line, either in full or in part, recompiling the software with the new configuration data, and bringing the system back online. For many businesses and government operations, this is not only a tremendous inconvenience; it is a costly and precarious procedure.

Routinely, in the course of maintaining a large, sophisticated information system, the need arises to reconfigure aspects of the domain environment that defines the system. Domain data can be considered both the arena within which the system operates and the static, semi-permanent constructs that serve as vehicles, parameters, and mechanisms for carrying out business operations through the system. Much of this static domain data represents actual, physical devices that are themselves subject to reconfiguration, replacement, and inclusion in the system. In general, a change to domain data is either driven by (1) changes to the physical environment emulated by the software, or (2) by a decision to reconfigure the definition of domain data to optimize, correct, or simply the role of these static elements in the information system. Once a change is decided upon, the development of the reconfiguration "change set" is invariably performed offline, usually by a back office system administrator, software engineer, or database personnel. Developing the "change set" offline has many advantages. It offers the opportunity to create the new configuration independent of the various technical and business constraints imposed by an operational environment, allows for desk-checking, automated testing, and database validation. Once ready for incorporation, the offline developer needs to make the change set available to the information system. Most prior art data reconfiguration methods produce an entirely new baseline database to be manually uploaded into the system at a time when the system can be taken down with relatively little impact on operations.

The loss of revenue due to "downtime", or worse yet the potential for human casualty, can make database changes (or upgrades) a harrowing ordeal for the maintainer of the system. Dispatching and control systems are particularly vulnerable to the adverse effects of downtime. Whether the system is responsible for controlling aircraft, trains, military drones, or satellites, the need to maintain continuous operation is essential. It is also imperative to minimize the affected area of the system and to constrain the disruption to the fewest functions possible. Clearly, a means of maintaining a high level of system availability while reconfiguring a system's static domain data during run-time is the ideal, but it can be as technologically challenging as changing the carpet out from under the feet of guests at a cocktail party. The difficulty lies in the established dependencies among transient data, the complex interactions among software objects, and the ability of the software to recognize and incorporate not only changes, but additions and deletions, as well, without adversely impacting or corrupting the system.

The present disclosure addresses the problems identified in the prior art by allowing reconfiguration of domain data to the run-time system without requiring the system to be taken down, and to limit reconfiguration to only the affected data.

In another aspect, the present disclosure maximizes the availability of system functions by limiting the reconfiguration to only the affected data. In a further aspect, the present disclosure minimizes the number of affected entities, offers alternative configuration changes from a common baseline, and performs run-time reconfiguration in real time. In another aspect the present application detects dynamic software entities currently using the domain data subject to change and (a) automatically removes from the system those dynamic entities that are non-critical, (b) coordinates the removal of problematic dynamic entities through a user interface, and (c) updates the remaining dynamic entities to reflect data changes.

DETAILED DESCRIPTION OF THE DRAWINGS

When an information system is upgraded or altered in some way, it is typically done for one of three reasons: (1) to fix problems with the software (i.e., to apply a "patch"); (2) to enhance—or add new features to—the existing implementation (i.e., to install a version upgrade); or (3) to reconfigure domain parameters, or entities, upon which the software operates. Virtually every information system contains an array of domain-specific entities, emulated in software, which the software system must "know about", manipulate, and interact with during processing. For example, in an Airport Management System, these domain entities could be the runways available for landing, a fueling station, or a baggage-handling unit. When the airport gains a new runway as the result of an airport expansion project, there is a fundamental change to the domain environment within which the system operates. In a railroad dispatching system, domain entities include trains, stations, switches, track segments, signals, and electric locks, actual devices connected to field circuitry that receive controls and send indications via a specialized protocol. When one railroad loses a station to another railroad, perhaps due to an acquisition, there is a similar structural change that needs to be assimilated. In each of the above examples, for the information system to operate properly, a new configuration of static domain data needs to be defined and "uploaded" into the system.

Figure 1:
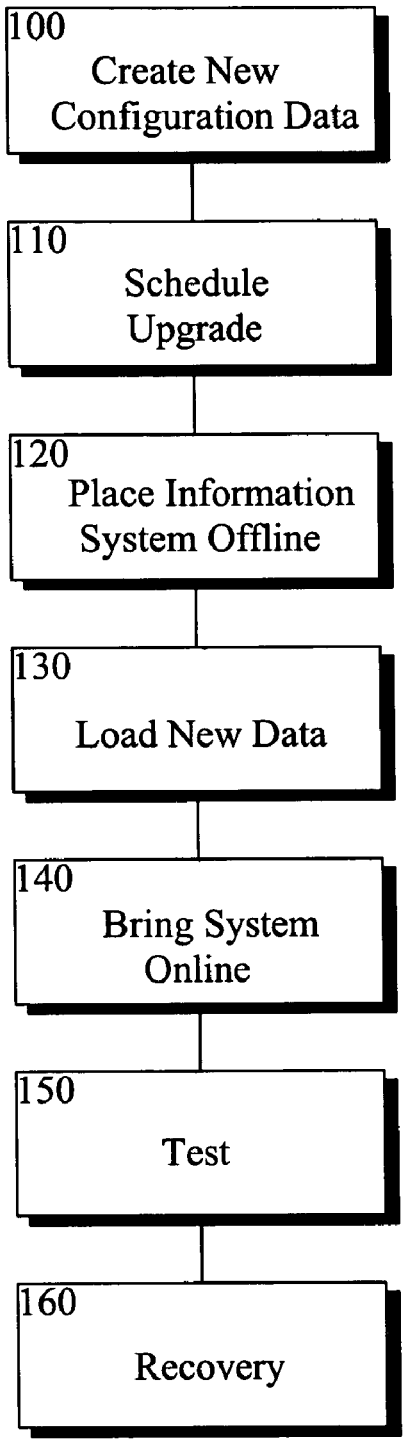
FIG. 1 PRIOR ART
FIG. 1 is a simplified block diagram of a prior art method of reconfiguring domain data offline and implementing it in an information system.

FIG. 1 illustrates a prior art method of implementing an information system upgrade to accommodate changes to a system requiring reconfiguration of its domain data. In step 100, a new change set of the domain data is created. As part of this step, the change set is check for accuracy and validated.

In step 110, the upgrade is scheduled during a period of low system usage. Because reconfiguration of domain data typically requires that the software program using the data be taken offline, it is critical that the configuration upgrade be performed during an off-peak period of low resource usage. In order to take a critical software system offline, it is necessary to coordinate the operational activities that will be taking place during the period of downtime to ensure that access to the offline software system is not necessary, and to minimize any impact to the system. As used in this disclosure, when a system is taken off-line, it is accessible only to the personal performing maintenance and is not accessible to other programs or to end users.

In step 120, the software system is placed offline. When a system is placed offline, the operational user does not have access to the system resources, and is unable to perform normal operations, until the system is brought back online. In some systems, it may be possible to place only a portion of the system offline.

In step 130, the new configuration of domain data is loaded.

In step 140, the system is brought back online.

In step 150, a battery of tests is performed to ensure the new configuration is verified as complete and satisfactory. Once a change set has been applied, extensive testing and a functional "check-out" are performed by test, maintenance, and operational personnel to verify the correctness and integration of the new configuration. Importantly, if anomalies are detected, the configuration change must be reversed, and the system must be returned to its original configuration, to ensure the continuity of operations. Typically the "reversing" procedure requires placing the system offline again, in full or in part, reconfiguring the domain data, recompiling the software, if necessary installing the old software and bringing it back online. Thus, the typical method of incorporating a configuration change set requires that the system be taken offline both for the installation of the change set, as well as to return the system to its original configuration if problems are encountered during installation of the new domain data configuration.

In practice, it is not uncommon to take a software system offline, implement a change, bring the system back online, encounter a problem, take the system offline again, reverse the configuration change, restore the original domain data configuration, and bring the system back online. Most of the problems encountered when reconfiguring domain data are due to the difficulty in identifying the interrelationships between entities and predicting the effect that a change to one entity will have on another entity. This is the "ripple effect" of data reconfiguration, and it is directly linked to the relationships among domain entities, relationships—often subtle and complex—that must be mined from the operational database schema.

If the software system taken offline is a critical system, it is likely that the denial of access to the system while offline has created adverse effects. Accordingly, in step 160, after the system is placed back online, it is necessary to remedy any adverse effect that may have been caused during the period that the system was offline.

In one embodiment of the present disclosure, and as described in greater detail below, the reconfiguration of domain data is accomplished without taking the software system offline. Instead, the system remains online for use by the operational user and access to the domain data is tightly controlled during the data reconfiguration, with greater flexibility provided to obviate some of the deficiencies noted in the prior art. For example, access may be granted to the domain data that is not subject to reconfiguration. The software system may be comprised of program modules, each of which may require access to portions of the domain data. Those program modules that require domain data undergoing reconfiguration may be disabled until the reconfiguration is complete, while those that do not require access to the data undergoing reconfiguration may be fully functional.

The example of a railroad dispatching system is used throughout this disclosure to demonstrate the complexities involved in applying a "change set" to an operational system and the challenges of incorporating changes within that environment, and discloses a suitable solution to incorporating run-time data changes. Those skilled in the art of data management will appreciate that the principles discussed herein may be applied to other systems, as well, and the present disclosure is in no way limited to railroad dispatching systems.

With respect to a railroad dispatching system where the domain data defines schedulable entities in the train network, the following examples illustrate some of the changes to domain data that may be implemented:

(1) Addition of a new entity. For example, a double-headed hold signal is added to a 20-mile section of track.

(2) Deletion of an existing entity. For example, the removal of two control points (including signals, switches, code stations and track).

(3) Association change, i.e., altering a relationship to another entity. For example, an association change may be (1) a dispatch territory is assigned to a different district, (2) a field traffic device is moved to a different track, or (3) a circuit is changed to indicate-in at a different code station.

(4) Attribute change, i.e., altering the setting of an entity's attribute. For example, an attribute change may be (1) the restoration time of a switch is changed from ten to thirty seconds, (2) a signal is changed from "slotting with transmit" to "no transmit", or (3) a station's name is changed from Edgewood to Tyler.

(5) Presentation change, i.e., altering the placement of an entity in a user's view. For example, a switch heater is moved from above track to below track.

In a railroad dispatching system, voluminous amounts of data are required to accurately emulate and interact with the railway infrastructure, trains, and the management information system responsible for planning train movements. When an aspect of a new system is replacing an old one, this data must be converted (as necessary), absorbed in the new system, and fully validated before the new system is approved for service. In the prior art systems, implementing the types of changes listed above typically could not be done online; the dispatching system would have to be placed offline and would not be available to the dispatcher during the downtime.

Figure 2A:
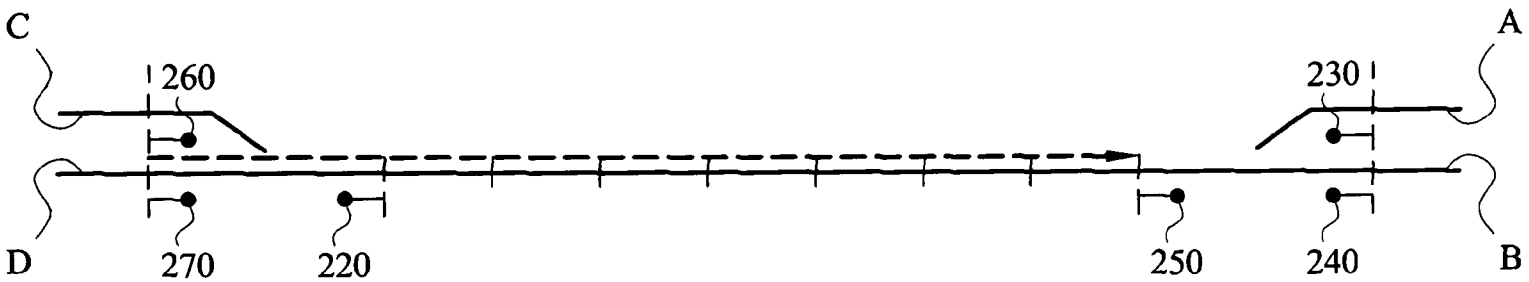
FIG. 2A is a simple pictorial representation of a portion of a railroad track network for use with an embodiment of the present disclosure
Figure 2B:
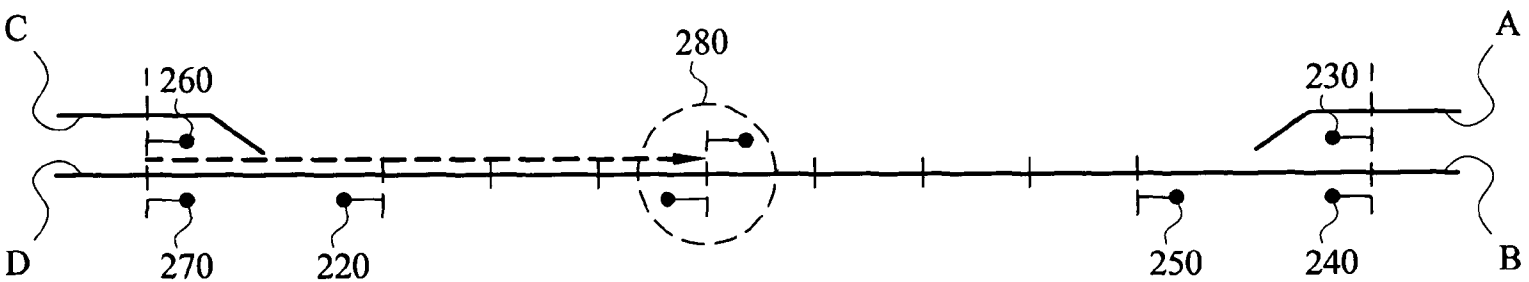
FIG. 2B is a simple pictorial representation of the portion of a railroad track network of FIG. 2A with the addition of a new domain data entity.

The impact of the addition of a double-headed hold signal is illustrated in FIGS. 2A and 2B. In FIG. 2A, two lamp routes (paths) run from Control Point 8 (CP8) to Control Point 9 (CP9), and two lamp routes run in the opposite direction from CP9 to CP8. It is understood that each route extends from forward-facing signal to forward-facing signal and are essentially for train routing. Accordingly, lamp route A goes from signal 230 to 220; lamp route B from 240 to 220; lamp route C from 260 to 250; and lamp route D from 270 to 250. After the addition of a double-headed hold signal 280, as shown in FIG. 2B, new lamp routes A, B, C and D terminate at the new hold signal 280. Before implementation of the configuration change that adds the new signal 280, the software does not recognize the new hold signal even if it physically installed in the track network, and continues to route trains according to the initial lamp routes A, B, C, or D prior to the change. By inserting a new entity 280, we have caused ramifications to a number of other entities. Moreover, to be useful, the hold signal 280 needs operations, control bits, indication bits, and an association to a code station. Improper configuration could render the signals useless, misrepresent a train's movement, strand a train, or worse yet cause a software program failure or "crash".

Note that the addition and deletion of railroad domain entities, particularly those that communicate to the dispatch center via an established protocol, invariably require reconfiguration of electronic circuitry in the field, which is usually done before the dispatching system is expected to accommodate the change. However, this does not obviate the need to upgrade the software, nor does it increase the likelihood of a "bug-free" upgrade. The only true benefit of procedurally upgrading the field before the office is being able to immediately begin testing the new configuration once the upgrade operation is complete.

Figure 3A:
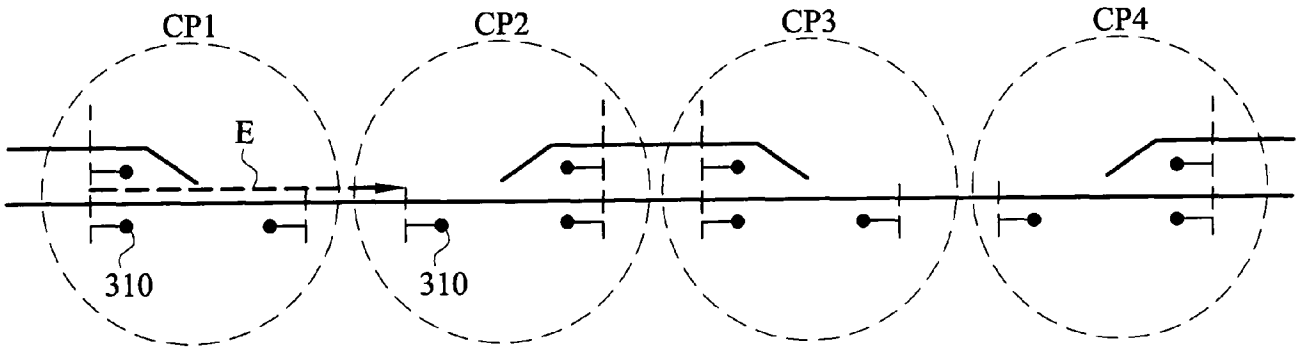
FIG. 3A a simple pictorial representation of a portion of a railroad track network for use with an embodiment of the present disclosure.
Figure 3B:
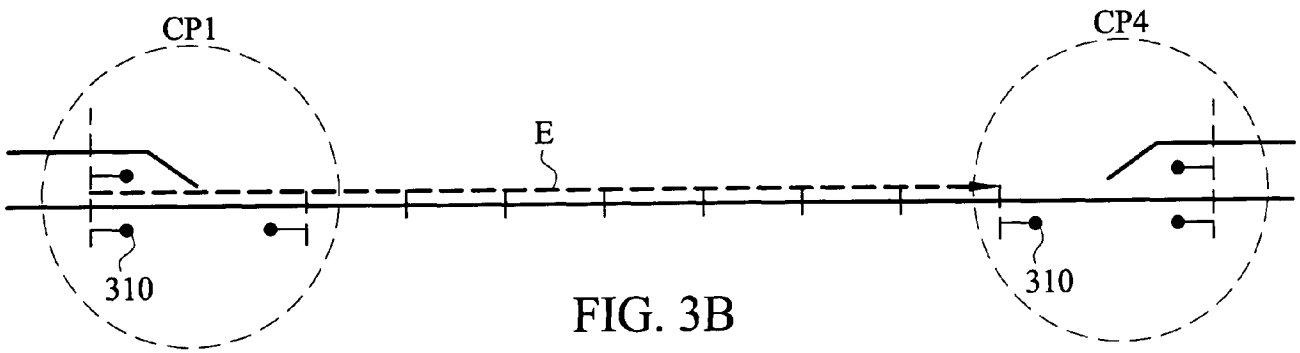
FIG. 3B is a simple pictorial representation of the portion of the railroad track network of FIG. 3A with the deletion of a domain data entity.

FIGS. 3A and 3B illustrate the removal of two control points (CP2 and CP3). The ramifications to lamp routes are obvious. Before deletion of CP2, lamp route E extends form forward facing signal 310 to forward facing signal 320. After the deletion of CP2 and CP3, lamp route E extends form forward facing signal 310 to forward facing signal 330. Circuits may have had their length changed, been reconnected to different circuits, or been changed from an OS circuit to a non-OS type circuit. An incorrect reconfiguration could affect tracking, auto-routing, signal clear operations, and the issuance of form-based authorities (among other dispatching functions). Thus, it is important that the relationship between entities is fully understood before changes to the domain data are made. In order to accomplish this, the system must ensure that changes to the domain data can be made without adversely impacting other entities. The system needs to be able to identify the relationships between entities affected by the domain data change and when there is a conflict, needs to be able communicate to the user that an upgrade cannot be performed until the identified entities are operationally addressed, as necessary, to allow application of the change set. This requires a thorough understanding of how static domain entities interact with dynamic entities in the system, and how the various types of data changes will affect those relationships.

In one embodiment, only those data configuration changes that affect dynamic entities that are unable to recover or incorporate the changes in the normal course of processing are rejected.

As part of applying the change set, a user interface is used to identify those entities that may be adversely affected by the domain data reconfiguration and disallows proceeding until the affected dynamic entities are either removed or suitably addressed. Other entities not adversely affected by the run-time reconfiguration are updated to reflect the domain data changes. To minimize the impact on operations, it is important to localize the affected region, or set of objects, to the smallest portion of interrelated domain data. Thus, in one embodiment, the system attempts to apply a reconfiguration of domain data at run-time that strictly localizes the affected region of the system, implements the upgrade in a matter of minutes, and maximizes the availability of system functions. For example, with reference to FIGS. 3A and 3B, the deletion of the control points in a railroad dispatching system requires that new circuit paths are created, that the appropriate dispatch territory and district lose a circuit, that the circuits be deleted from one or more lamp routes, and so on. All these entities are affected by the deletion of control points. Dispatch territories and districts are large domain objects encapsulating many entities. To render entities "out of service" to perform such a reconfiguration would certainly compromise the dispatching of trains and adversely affect business by delaying trains from delivering their freight to their destination stations. Thus, minimizing the affected area of an upgrade is essential to sustaining business operations. Equally critical is the need to minimize system "down-time". Obviously, going without use of a section of track for ten minutes, for instance, is dramatically better than going without it for two hours.

In the present disclosure, a link is made between the operational system and the offline repository of change sets so that change sets can be readily retrieved, on demand, without taking the software system offline and with only minimal disruption to normal dispatching operations.

In one aspect of the present disclosure, strict configuration management is maintained by producing domain data change sets in pairs: (1) the user-defined change set; and (2) the automatically generated "reverse change set", or undo change set, which allows change set reversal by the same means of applying a new change set. Once a change set has been retrieved by the operational system, it is then "locked" from any further modification.

Figure 4:
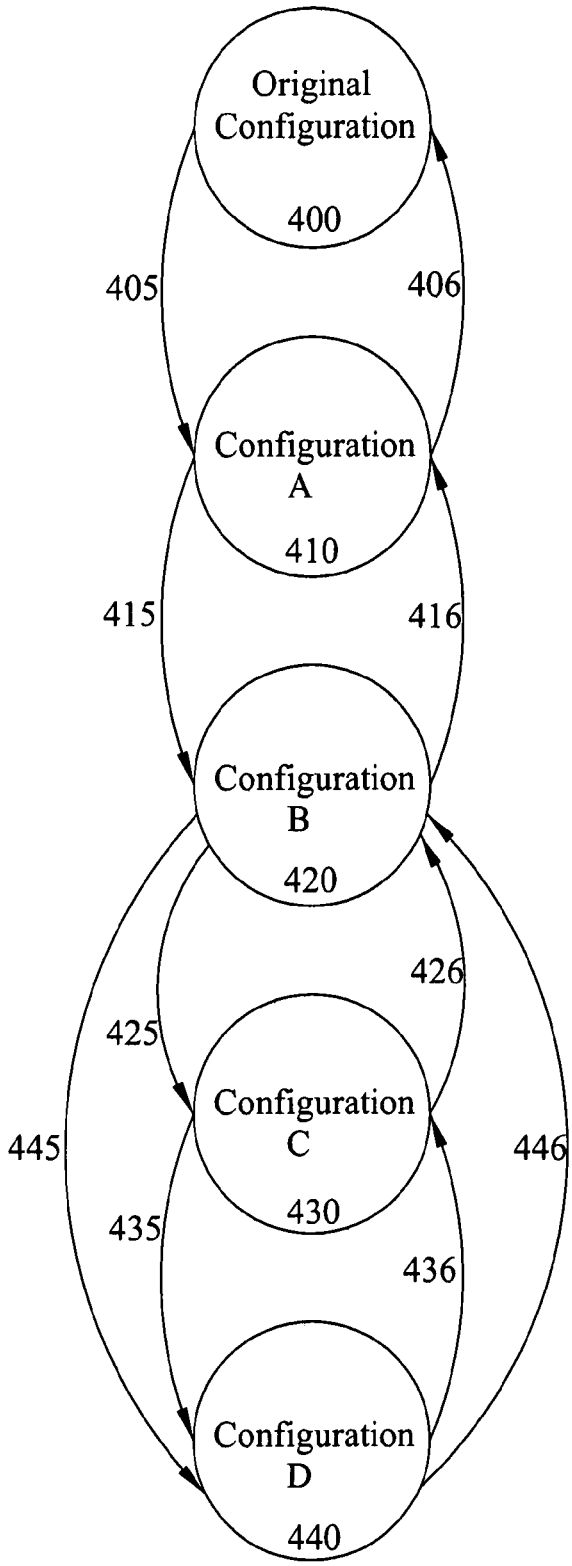
FIG. 4 is a simplified pictorial representation illustrating the use of change sets and reverse change sets to make online changes to the domain data in one embodiment of the present disclosure.

FIG. 4 illustrates one embodiment of the present application. The current configuration of domain data 400 is known as the baseline. Modifications to the baseline data are implemented using a change set. For each change set generated, a reverse change set is automatically generated which can be used to quickly return the domain data to the baseline if problems are encountered during the implementation, testing or validation of the change set.

Operationally, in the railroad context, a dispatcher or supervisor initiates the online implementation of a change set.

While change sets can be localized in practice, the present disclosure also allows the entire railroad's domain data to be loaded—or replaced—as a single change set, without any deviation from the normal procedure. The content and scope of a change set depends entirely on the configuration defined by the data manager.

In operation, the data manager is presented with the current configuration of the domain data baseline 400 and a list of "configuration versions" to which the system may migrate. Choosing a target configuration version is equivalent to applying a change set. For example, it may be desired to implement Configuration A by applying Change set A 410 to baseline 400.

During the application process 420, which may take anywhere from a few seconds (one device) to 60 minutes (an entire division) depending on the size of the change set, the run-time system disables the affected area by rendering the applicable domain data inaccessible in all users' displays via a graphical user interface, and by internally blocking access to the underlying data. Examples of how this may be accomplished include: (a) by disallowing access to user functions (e.g., by graying-out context menus and rendering user interface objects non-selectable), and (b) by internally rejecting requests to access the domain data subject to change.

In determining the extent of a change set, it is necessary to identify the entities that will be affected by the implementation of the change set to smartly schedule the reconfiguration event. This identification requires a thorough understanding of how static domain entities interact with dynamic entities in the system, and how various types of data changes will affect those relationships. As a result, it may be preferable to implement a series of change sets rather than a single change set. For example, in FIG. 4, the run-time configuration change includes five possible Configuration versions (the original baseline and four changed configurations). Applying change set A 405 results in Configuration A. If it is necessary to return to the original domain data baseline 400, reverse change set A 406 may be applied to Configuration A 410. Change set A 405 and change set B 410 can be applied sequentially to achieve Configuration B 420. If a problem is encountered during the application of change set B 415, reverse change set B 416 may be applied, which returns the system to Configuration A 410 rather than returning to the baseline 400.

In some cases, it may be preferable to produce several alternative change sets for a given software baseline. This might be needed for training purposes in a "test bed", or when the correct configuration of a large, complex set of domain data is not completely known or understood. In one embodiment of the present disclosure (see FIG. 4), a data manager may create an unlimited number of alternative change sets emanating from a common configuration, each with its own "reverse change set" to be brought back to the common configuration should the applied change prove unsatisfactory. For example, three change sets may be developed to change from Configuration B 420 to Configuration D 440. Change set C 425 may be applied followed by change set 435 in order to achieve Configuration D 440. In the alternative, change set 445 may be applied to directly change from Configuration B 420 to Configuration D 440 without migrating to Configuration C 430. In either case, reverse change sets 426, 436, 446 are provided to quickly reverse the implementation of these change sets if any problems are encountered. Thus, the technical effect is that a change can be made to the domain data without taking the software system offline.

In another embodiment in the present disclosure, the run-time reconfiguration process detects affected dynamic entities in the system and presents the user with a solution strategy. For example, if a movement authority, which is a dynamic railroad-domain entity authorizing movement of a train, were in the affected area prior to application of a change set, the change set solution would reject the dispatcher's attempt to apply the change set, identify the offending entity, and communicate that the movement authority needs to be removed in order to proceed. Likewise, there could be other offending entities in the affected area such as trains, bulletins, and trip plans. The change set solution identifies each offending entity, presents them in a list for the user to address, and applies the reverse change set process to the current baseline. Other dynamic entities, not considered critical, may be either automatically removed from the system during the change set process, or updated to reflect the data configuration changes once the change set process is complete.

Another aspect of the present disclosure involves the recreation of domain entities that are temporarily removed during the change process. For example, in one embodiment, the run-time reconfiguration process automatically reapplies track blocks over an affected area. For example, whenever a section of railroad topology is planned for reconfiguration, it is normal operating procedure for responsible personnel to put down one or more track blocks over the affected area, as a safety precaution, to prevent access to the tracks. These dynamic entities are not considered offending entities that inhibit application of a change set, nor are they suppose to be automatically removed from the system. They actually need to be reapplied, either in full or in part, based on the extent of the topology change. If the entire track they cover is being deleted, or the specific track used to initiate the block is being removed in the change set, then the block is automatically removed; otherwise, it is recreated on the remaining track.

Figure 5A:
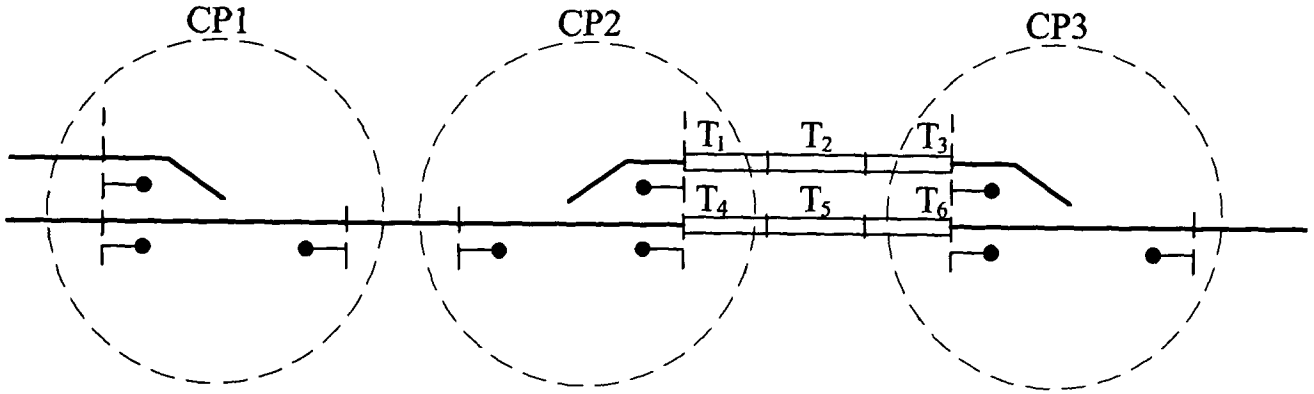
FIG. 5A is a simplified pictorial representation of a portion of the railroad track network with track blocks applied for use with one embodiment of the present disclosure.
Figure 5B:
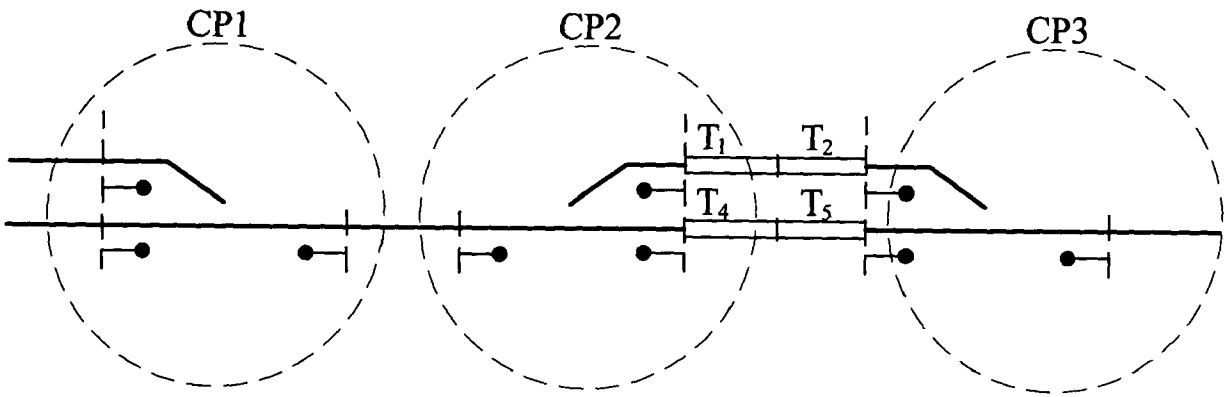
FIG. 5B is a simplified pictorial representation of the railroad track portion of FIG. 5A after deleting a portion of the track and reapplying the track block.

FIGS. 5A and 5B illustrate the run-time recreation of two track blocks by the implementation of a change set solution. In this change set, track sections T3 and T6 are being removed from the railway network. Prior to application of the change set, operating personnel create and put down track blocks over the affected area, tracks T1 through T3 and T4 through T6, in anticipation of their removal and to prevent trains from being inadvertently routed onto the track. After successful application of the change set, the track blocks are deleted, recreated, and reapplied automatically to the remaining tracks (T1 through T2 and T4 through T5) by the change set solution.

Another aspect of the present disclosure is that when domain data has been successfully reconfigured, the movement planner is notified and the movement plan is will then automatically update the existing movement plans to take into account the changes made to the domain data. The automatic regeneration of the movement plan helps minimize any disruptions that may be caused by the reconfiguration of the domain data.

Figure 6:
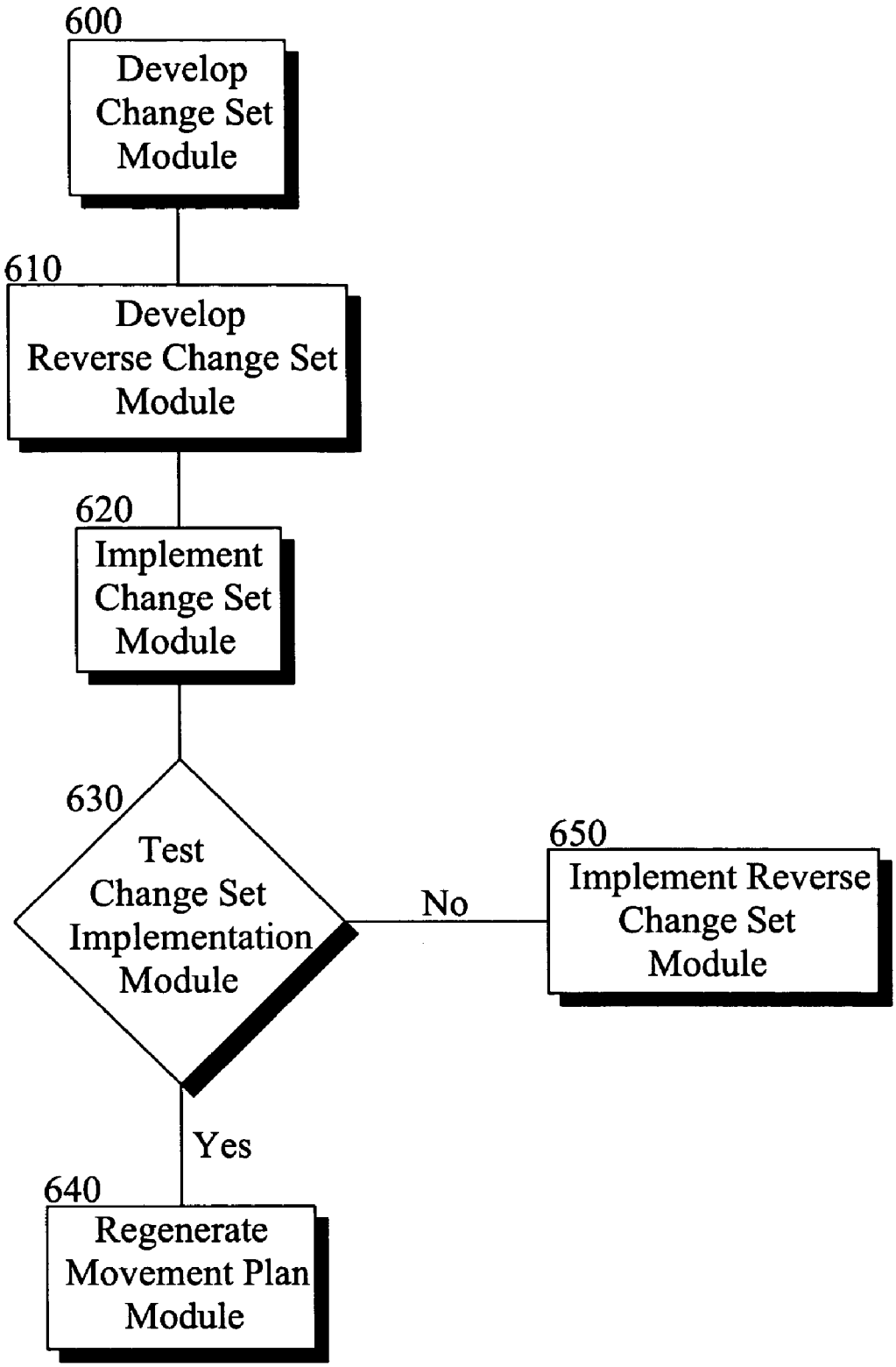
FIG. 6 is a simplified pictorial representaion of an implementaion of one embodiment of the present disclosure.

FIG. 6 illustrates one implementation of one embodiment of the present disclosure using computer readable program code modules. The computer readable program code modules can be operated on by a general purpose or specially programmed computer as is well known to those skilled in the art. To initiate a run time configuration change to domain data, a change set is developed in the develop change set model 600. Once the change set is developed, a reverse change set is developed by the reverse change set module 610. The change set is then implemented by the implement change set module 620. Once the change set is implemented, the change set is evaluated and tested in the test change set implementation module 630. The test change set implementation module 630 evaluates the implementation of the change set against a predetermined criteria which ensures that the domain data has been satisfactorily reconfigured and available for use by information system. If the test is satisfactory, the regenerate movement plan module 640 regenerates that portion of the movement plan affected by the reconfiguration of the domain data. If the test is unsatisfactory, the implement reverse change set module 650 returns the domain data to the baseline domain data configuration.

In summary, the change set solution provided by the present disclosure minimizes disruption of dispatching operations, offers easy application of multiple change sets complete with the ability to reverse those changes, and accommodates the interaction of dynamic domain objects by rejecting requests, automatically deleting objects, and recreating objects in the new, reconfigured environment.

While preferred embodiments of the present invention have been described, it is to be understood that the embodiments described are illustrative only and the scope of the invention is to be defined solely by the appended claims when afforded a full range of equivalents, many variations and modifications naturally occurring to those of skill in the art form a perusal hereof.

What is claimed:

1. In a train dispatching system for controlling the movement of plural trains over plural track resources, the plural track resources being defined by domain data, a method of modifying the domain data comprising:

(a) developing a first change set of intended modifications to the domain data, wherein the domain data defines the physical assets and devices that make up the rail network over which the plural trains travel, (b) developing a second change set of intended modifications to the domain data which reverses the modifications made by the first change set, (c) implementing the first change set to a domain data baseline in real-time while the dispatch system remains online and operational to users of the dispatching system during implementation of the modification to the domain data, including (i) determining the domain data to be modified by the first change set, (ii) making the domain data to be modified inaccessible to users of the dispatching system until the first change set has been successfully implemented, (iii) preventing the implementation of the first change set if the domain data to be modified is currently being accessed by the dispatching system; and (iv) notifying a user if the implementation of the first change set is prevented;

(d) evaluating the operational implementation of the first change set in real-time against a predetermined criteria; and (e) implementing the second change set in real time if the evaluation of the first change set does not satisfy the predetermined criteria to return the domain data to the domain data baseline.

2. The method of claim 1 wherein the step of implementing a first change set comprises:

(i) determining the domain data to be modified by the first change set; and (ii) making the domain data to be modified inaccessible to users of the dispatching system until the first change set has been successfully implemented.

3. The method of claim 2 wherein the step of implementing the first change set further comprises:

(iii) preventing the implementation of the first change set if the domain data to be modified is currently being accessed by the dispatching system.

4. The method of claim 3 wherein the accessed domain data that is preventing the implementation of the first change set is identified to a user of the dispatching system.

5. The method of claim 2 wherein the step of making the domain data inaccessible includes disabling context menus and functions in a graphical user interface.

6. The method of claim 1 wherein the step of implementing the first change set comprises:

(i) identifying the domain data to be modified by the first change set that is subject to a safety constraint; and (ii) applying the safety constraint to the identified domain data prior to implementation of the modifications.

7. The method of claim 6 wherein the safety constraint comprises a track block.

8. The method of claim 6 wherein the step of implementing the first change set further comprises:

(iii) reapplying the safety constraint following implementation of the modifications.

9. The method of claim 4 wherein the accessed domain data that is preventing the implementation of the first change set is identified to a user by a graphical user interface.

10. The method of claim 1 wherein a movement plan for controlling the movement of the plural trains over the plural track resources is automatically generated following successful implementation of the first change set.

11. In a train dispatching system for controlling the movement of plural trains over plural track resources, the plural track resources being defined by domain data, a method of modifying the domain data comprising:

(a) developing a first change set of intended modifications to the domain data, wherein the domain data defines the physical assets and devices that make up the rail network over which the plural trains travel;

(b) developing a second change set of intended modifications to the domain data which reverses the modifications made by the first change set;

(c) implementing the first change set to a domain data baseline in real-time while the dispatching system associated with the domain data remains online and operational to users of the dispatching system during implementation of the modification to the domain data, including (i) determining the domain data to be modified by the first change set, (ii) making the domain data to be modified inaccessible to users of the dispatching system until the first change set has been successfully implemented, (iii) preventing the implementation of the first change set if the domain data to be modified is currently being accessed by the dispatching system; and (iv) notifying a user if the implementation of the first change set is prevented;

(d) evaluating the operational implementation of the first change set in real time against a predetermined criteria; and (e) implementing the second change set in real time if the evaluation of the first change set does not satisfy the predetermined criteria to return the domain data to the domain data baseline.

12. The method of claim 1, wherein the domain data defines at least one of switches, track segments, or signals.

* * * * *

UNITED STATES PATENT AND TRADEMARK OFFICE

CERTIFICATE OF CORRECTION

PATENT NO. : 7,908,047 B2
APPLICATION NO. : 11/142260
DATED : March 15, 2011
INVENTOR(S) : Smith et al.

It is certified that error appears in the above-identified patent and that said Letters Patent is hereby corrected as shown below:

In Column 1, Line 24, delete “figured” and insert -- configured --, therefor.

Signed and Sealed this
Eleventh Day of October, 2011

David J. Kappos

David J. Kappos
*Director of the United States Patent and Trademark Office*